US005471130A

United States Patent [19]

Agiman

[11] Patent Number: 5,471,130

[45] Date of Patent: Nov. 28, 1995

[54] POWER SUPPLY CONTROLLER HAVING LOW STARTUP CURRENT

[75] Inventor: Dan Agiman, Rosh Haain, Israel

[73] Assignee: Linfinity Microelectronics, Inc., Garden Grove, Calif.

[21] Appl. No.: 151,512

[22] Filed: Nov. 12, 1993

[51] Int. Cl.[6] ..... G05F 5/00

[52] U.S. Cl. ..... 323/303; 323/274; 323/281; 323/284

[58] Field of Search ..... 323/273, 274, 323/275, 281, 282, 283, 284, 285, 299, 303

[56] References Cited

U.S. PATENT DOCUMENTS 4,792,747 12/1988 Schroeder ..... 323/274 X

*Primary Examiner*—Peter S. Wong
*Assistant Examiner*—Jessica Han
*Attorney, Agent, or Firm*—Spensley Horn Jubas & Lubitz

[57] ABSTRACT

A power supply controller includes a comparator for providing a regulated voltage when an input voltage exceeds a reference voltage, so that a reference voltage is provided to drive a load discharge circuit. When the input voltage is less than the reference voltage, such as during a startup or sleep mode of operation of the controller, the load discharge circuit is driven by an output pulldown circuit so as to maintain minimum functions within the integrated circuit of the controller including turnoff of an external MOSFET. The output pulldown circuit senses the resulting absence of the regulated voltage using a first transistor coupled to be biased into nonconduction when the regulated voltage is not provided. This biases a second transistor into conduction to maintain a transistor within the load discharge circuit conductive. In this manner, the output powers its own operation, including the pulldown thereof. The controller enables a relatively small startup current to be used, utilizes multiple outputs, and eliminates temperature dependence of the startup current.

27 Claims, 5 Drawing Sheets

POWER SUPPLY CONTROLLER HAVING LOW STARTUP CURRENT

BACKGROUND OF THE INVENTION

1. Field of the Invention

The present invention relates to power supply controllers for providing a power output; in response to a variable input voltage.

2. History of the Prior

It is known in the art to provide power supply controllers for providing a power output in response to a variable input voltage. Typically, such controllers include a comparator for comparing the input voltage with a threshold value together with circuitry for driving a lead circuit when the input voltage exceeds the threshold value. During certain operating conditions of the power supply controller, such as during the startup or "sleep" mode of operation, the startup current of the controller assumes a low level so that little power is consumed. At the same time, the lead circuit must be driven to such an extent that minimum functions of the controller are provided. Among other things, the lead circuit must be maintained in a pulldown mode so as to be capable of turning off an external MOSFET or other load having capacitance in an integrated circuit portion of the controller. Otherwise, the gate on the MOSFET may become isolated or floating when the remainder of the circuit is powered down, leaving the MOSFET potentially operative. Therefore, it is necessary to ensure that the voltage on the gate of the MOSFET or other external capacitive load is discharged.

With traditional power supply controllers of the type described, the controller is shut down when the input voltage is too low. Thus, when the comparator determines that the input voltage is less than the threshold value, then the controller is shut down. At the same time, a fairly substantial startup current on the order of 500 μamperes or greater must typically be maintained during the startup mode, so that the controller can function properly.

A number of attempts have been made to improve the operation of power supply controllers during the startup mode. One such technique utilizes high value resisters for all startup functions and constantly powers a low voltage regulator to bias some of the functions. Such circuits, however, are wasteful in terms of the startup current which must be present as well as having other disadvantages. Such circuits typically have a single output point and have startup current temperature dependence. The constantly powered regulator provides a continuous reference, but at the expense of the high current resulting from the substantial current drain of the high value resistors.

It would therefore be desirable to provide an improved power supply controller which consumes very little current in the startup mode when the input voltage is below a threshold value. At the same time, such controller should be capable of powering necessary functions during the standby mode while maintaining the output in a pulldown mode with no current drain penalty. Such controller should also minimize temperature dependence of the startup current and provide multiple output points.

BRIEF DESCRIPTION OF THE INVENTION

Briefly stated, the present invention provides power supply controllers which consume very little startup current while maintaining the output in a pulldown mode. When the input voltage is less than the threshold value, a source of regulated voltage is turned off, and the absence of the regulated voltage is sensed by an output pulldown circuit which continues to drive the load circuit. The output pulldown circuit is powered by the output until the voltage at the output is eventually collapsed.

Thus, in power supply controllers according to the invention, the input voltage can assume a very low value without affecting operation, because the output voltage is not a function of the input voltage. A very low current is possible because the regulated voltage source is turned off, pulldown of the output is powered by the output, and the current sources are better controlled.

In a preferred arrangement of a power supply controller according to the invention, a comparator compares the input voltage with a threshold value represented by a reference voltage, and turns on a regulated voltage source whenever the input voltage exceeds the threshold value. A regulated voltage is provided to power the load circuit. When the input voltage is less than the threshold value, the regulated voltage source is turned off. An output pulldown circuit senses the absence of the reference voltage and pulls down the output using power provided by the output. In this way, minimum startup functions are maintained within the integrated circuit of the controller, including the ability to turn off an external MOSFET. At the same time the pulldown mode is maintained, using a very low current.

The pulldown circuit may comprise a first transistor coupled to be biased into nonconduction whenever the reference voltage is not provided. A second transistor is biased into conduction by the nonconduction of the first transistor to activate a current mirror and drive the load circuit. The load circuit includes a transistor which is maintained in conduction by the current mirror when the first transistor of the drive circuit is biased into nonconduction by the absence of the reference voltage.

BRIEF DESCRIPTION OF THE DRAWINGS

A better understanding of the invention may be had by reference to the following detailed description taken in conjunction with the accompanying drawings, in which.

DETAILED DESCRIPTION

Figure 1:
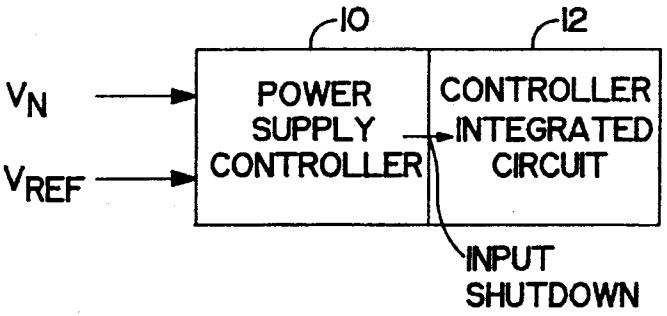
FIG. 1 PRIOR ART
FIG. 1 is a basic block diagram of a prior art power supply controller.

FIG. 1 shows a prior art power supply controller 10. The power supply controller 10 receives an input voltage $V_N$ and compares it with a threshold value, represented by $V_{REF}$. The input voltage $V_N$, which is not controlled, varies from values below $V_{REF}$ to values above $V_{REF}$.

The power supply controller 10 is the type which operates as a pulse width modulator. The controller 10 includes an integrated circuit portion 12 which controls various functions of the controller 10. Certain of those functions must be maintained, even during the startup "sleep" mode, requiring that a minimum startup current be available. At the same time, the controller 10 shuts down when $V_N<V_{REF}$. As shown in FIG. 1, an input shutdown is signaled to the integrated circuit portion 12 when $V_N<V_{REF}$. This is undesirable, inasmuch as certain minimum functions which must be maintained even during startup mode may not be maintained.

Figure 2:
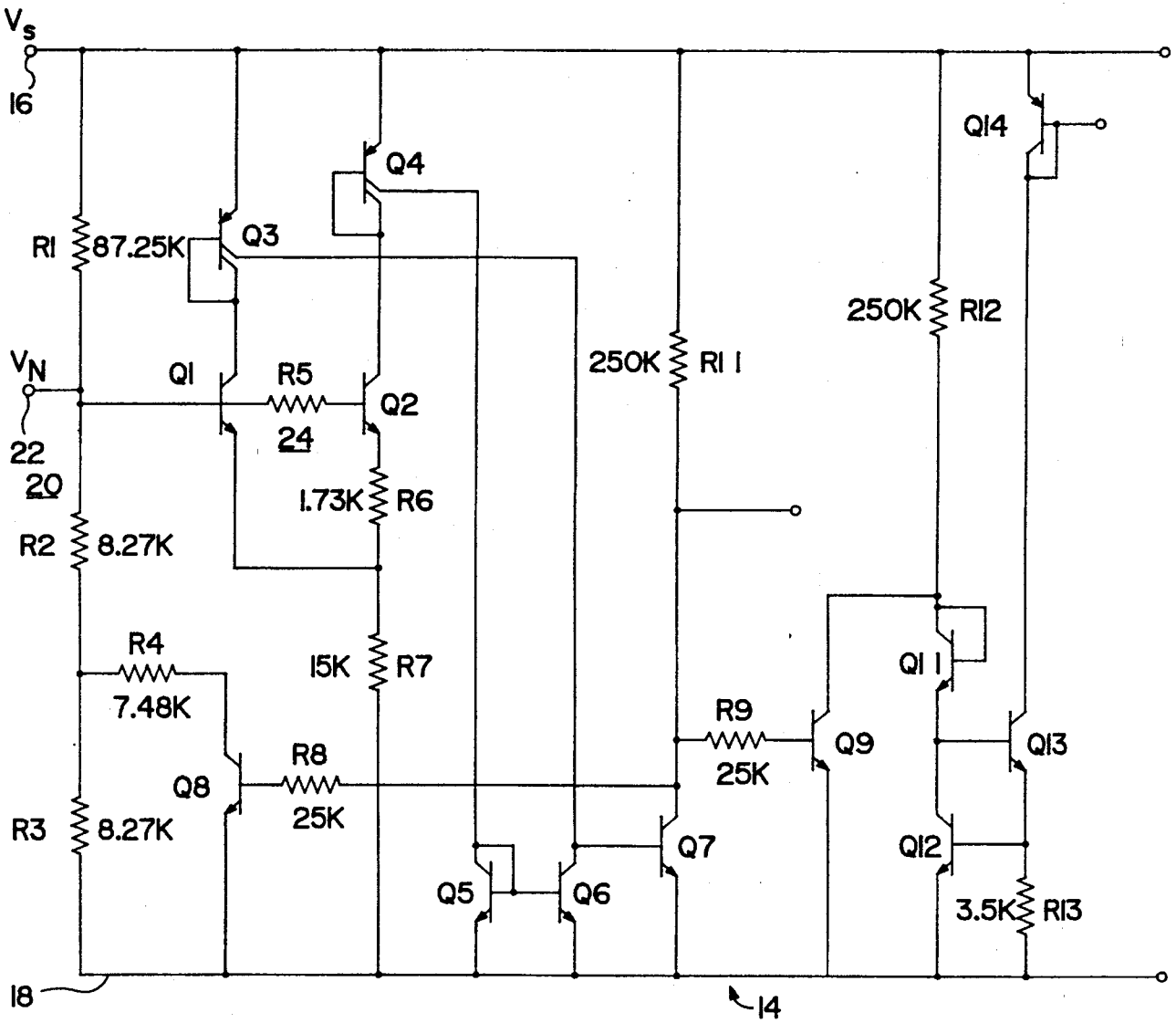
FIG. 2 PRIOR ART
FIG. 2 is a schematic circuit diagram of one example of a prior art power supply controller of the type shown in the block diagram of FIG. 1.

FIG. 2 provides a detailed example of the input portion of a prior art power supply controller 14 of the type shown in FIG. 1. The controller 14 of FIG. 2 receives a supply voltage $V_s$ at a terminal 16. The terminal 16 is coupled to an opposite lead 18 of the controller 14 through a serial arrangement of resistors R1, R2 and R3, which form a voltage divider 20. The voltage divider 20 responds to the supply voltage $V_s$ by sensing the input voltage $V_N$ at a terminal 22.

The terminal 22 of the controller 14 forms a part of a bandgap circuit which provides the reference voltage $V_{REF}$. A pair of transistors Q1 and Q2, together with resistors R5 and R6, form a ΔVBE generator 24. R7 is a ΔVBE voltage multiplier. ΔVBE, together with the ΔVBE multiplier, generates the reference voltage $V_{REF}$. Transistors Q1 and Q2 always conduct, but typically one conducts more than the other. When $V_N>V_{REF}$, transistor Q1 conducts more than transistor Q2 due to the presence of the resistor R6 in series with Q2. This increases the conduction of a transistor Q3, which affects the conduction of transistors Q6 and Q7 as described hereafter.

At the threshold, current into the VBE generator 24 is divided generally equally between the transistors Q3 and Q4. This produces equal currents in the transistors Q5 and Q6. The current in to the base of a transistor Q7 is equal to the difference between the currents in transistors Q3 and Q6. When $V_N<V_{REF}$, the current in transistor Q6 becomes greater than the current in transistor Q3, and this shuts off the transistor Q7. A transistor Q8 responds to the shutting off of the transistor Q7 by turning on, and this lowers the voltage at the terminal 22 even more. Conversely, when $V_N>V_{REF}$, transistor Q7 conducts and turns off transistor Q8. This tends to increase the voltage at the terminal 22 even more.

Therefore, when $V_N<V_{REF}$, the controller 14 of FIG. 2 responds by shutting down the input, as previously described in connection with FIG. 1. This is undesirable, inasmuch as a minimum startup current may not be available to power certain functions. In circuits according to the invention, however, circuitry is employed to continue driving the load circuit, even during startup or sleep mode.

Figure 3:
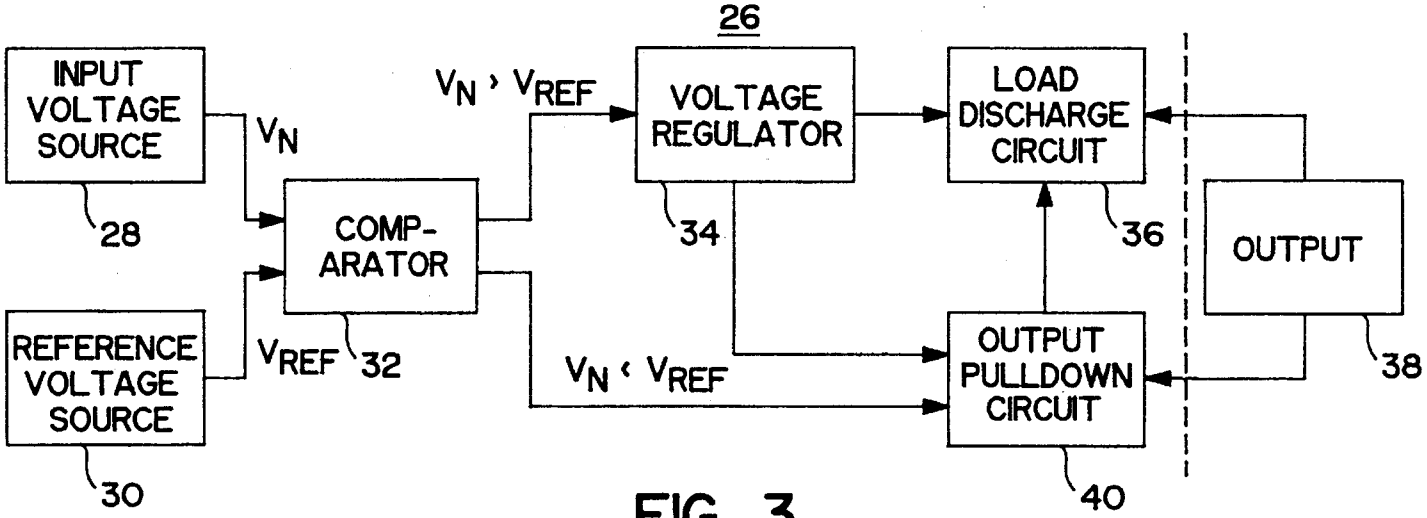
FIG. 3 is a block diagram of a power supply controller having low current startup in accordance with the invention.

A block diagram of a preferred arrangement of a power supply controller 26 having low current startup, in accordance with the invention, is shown in FIG. 3. The controller 26 includes an input voltage source 28 for providing $V_N$, a reference voltage source 30 for providing $V_{REF}$ and a comparator 32. The comparator 32 compares $V_N$ with $V_{REF}$ much in the same manner as described above in connection with FIG. 2. When $V_N>V_{REF}$, the comparator 32 turns on a voltage regulator 34 to power a load discharge circuit 36 with a regulated voltage. The load discharge circuit 36, which includes an output 38, may be of the capacitive load discharge type. The regulated voltage from the voltage regulator 34, which comprises a reference voltage, drives the circuit 36 to provide the various functions of the controller 26.

When $V_N$ becomes less than $V_{REF}$, the comparator 32 does not turn on the voltage regulator 34, and consequently the regulated voltage is not produced to drive the load discharge circuit 36. When this condition occurs, an output pulldown circuit 40 senses the absence of the regulated voltage and responds by driving the load discharge circuit 36. The load discharge circuit 36 is driven in a manner to ensure that the minimum required functions within the controller 26 are maintained, even though $V_N<V_{REF}$. In addition to such minimum functions, the load discharge circuit 36 remains capable of turning off an external MOSFET.

Figure 4:
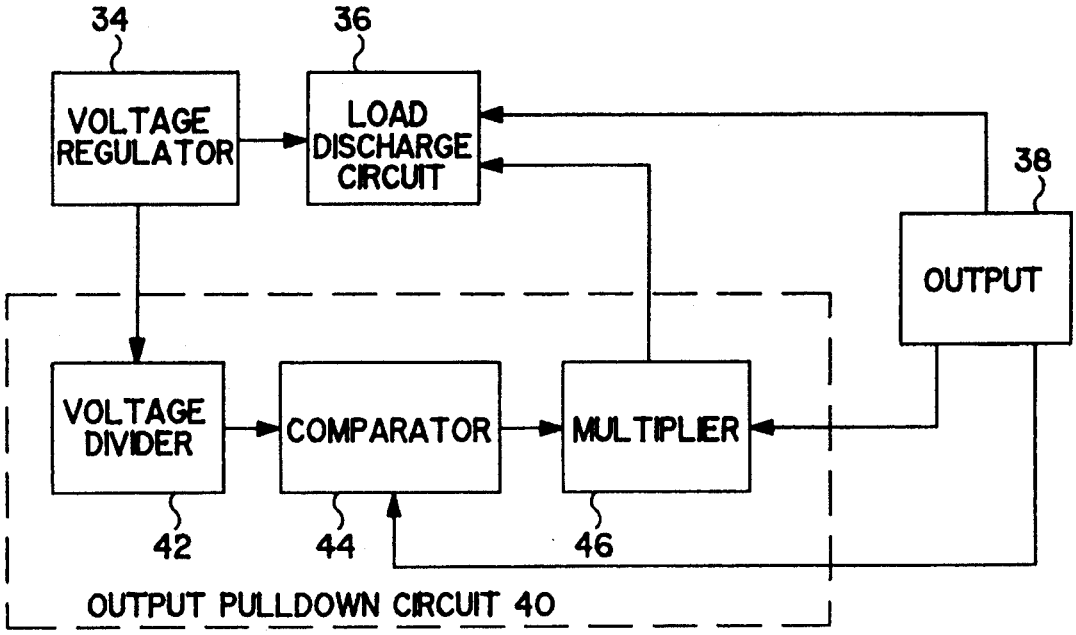
FIG. 4 is a block diagram of a portion of the power supply controller of FIG. 3 showing the output pulldown circuit in greater detail.

FIG. 4 shows the voltage regulator 34, the load discharge circuit 36 and the output 38, together with the output pulldown circuit 40. The output pulldown circuit 40 includes a voltage divider 42 for sensing when the regulated voltage is not provided by the voltage regulator 34 during conditions of $V_N<V_{REF}$. A comparator 44 and a multiplier 46 respond to the absence of the regulated voltage, as sensed by the voltage divider 42, to pull down the load discharge circuit 36 using power provided at the output 38, in a manner described in detail hereafter in connection with FIG. 5B. As shown in FIG. 4, both the comparator 44 and the multiplier 46 are coupled to be powered from the output 38.

Figure 5A:
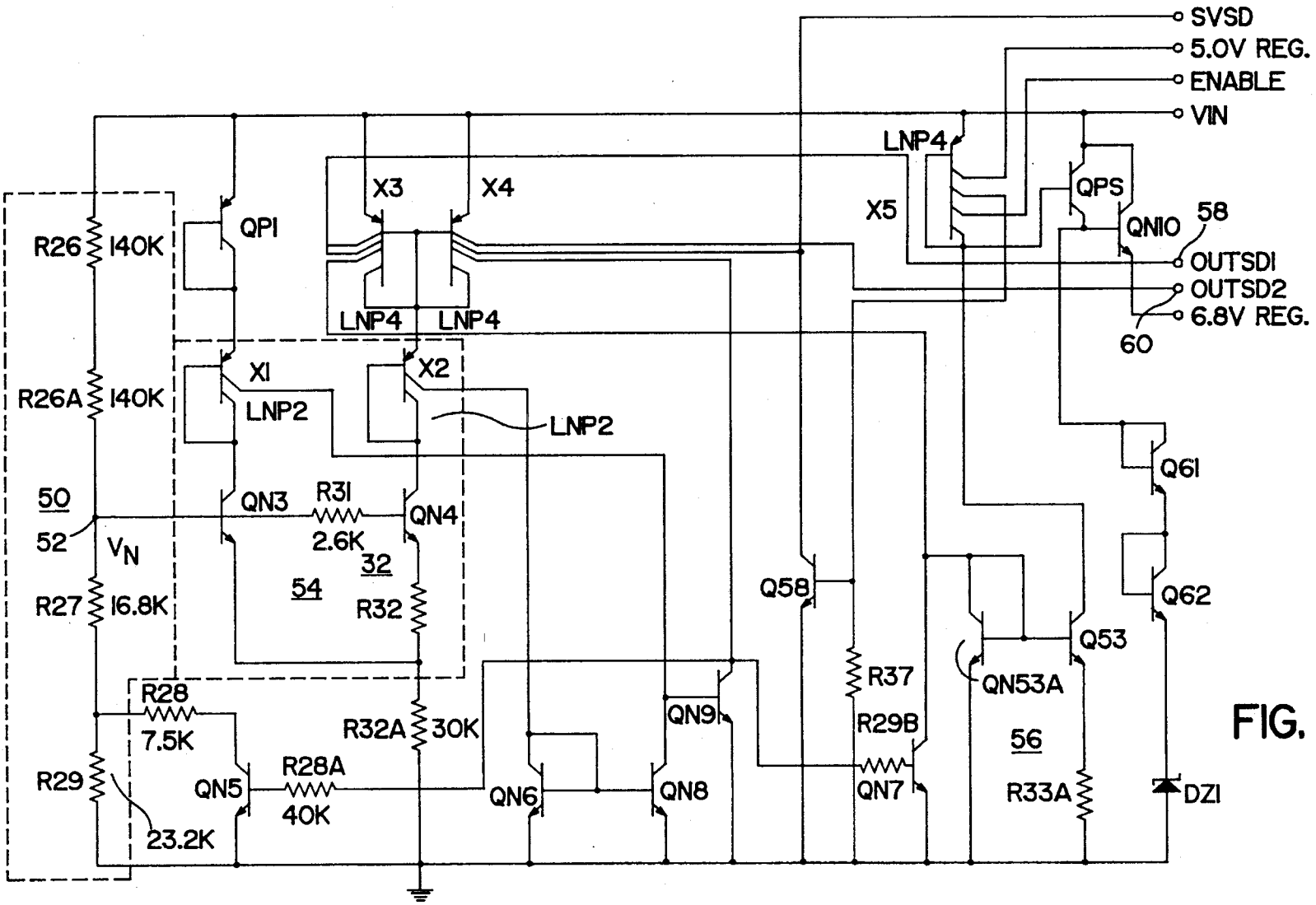
FIGS. 5A and 5B are schematic circuit diagrams of a detailed example of the power supply controller of FIG. 3.
Figure 5B:
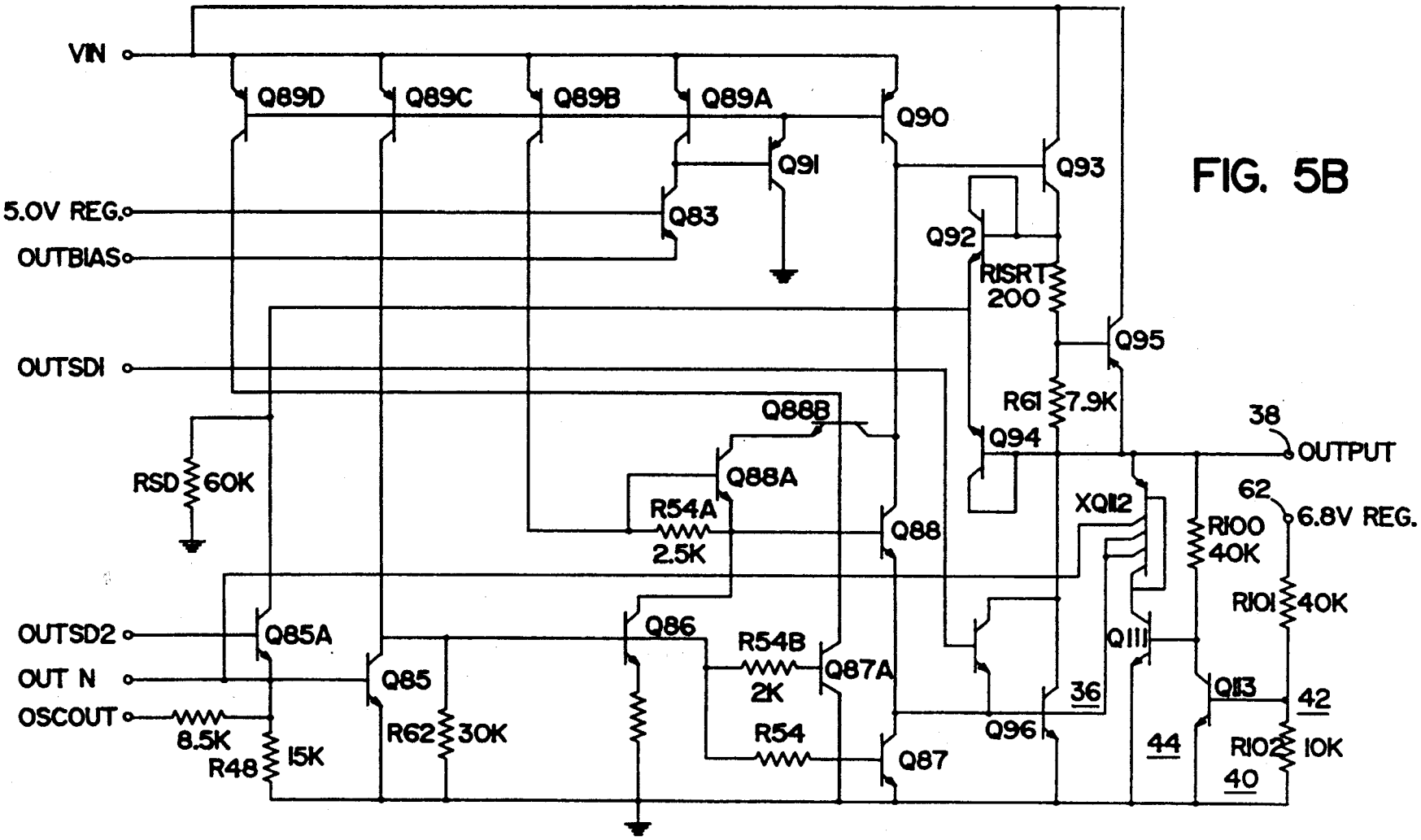

A detailed example of the controller 26 of FIG. 3 is provided by FIGS. 5A and 5B. FIG. 5A comprises a schematic diagram of circuitry comprising the input voltage source 28, the reference voltage source 30, the comparator 32, and the voltage regulator 34, of the controller 26 of FIG. 3. The schematic diagram of FIG. 5B includes circuitry comprising the load discharge circuit 36, the output 38 and the output pulldown circuit 40, of the controller 26 of FIG. 3.

Referring to FIG. 5A, a supply voltage VIN is provided to a voltage divider 50, which comprises the input voltage source 28. The voltage divider 50 is comprised of resistors R26, R26A, R27 and R29 coupled between the source of the supply voltage VIN and ground. A terminal 52 between the resistors R26A and R27A comprises a bias point for purposes of comparing the input voltage $V_N$ with the threshold value $V_{REF}$. Such comparison is performed by the comparator 32 which comprises a bandgap comparator 54. The bandgap comparator 54 includes a pair of transistors QN3 and QN4.

The supply voltage VIN is a multiple of the voltage present at the base of the transistor QN3 in the bandgap comparator 54. When the voltage at the base of the transistor QN3 exceeds the bandgap value ($V_{REF}$), a transistor QN9 is turned on. The transistor QN9 responds to operation of the transistors QN3 and QN4 within the bandgap comparator 54 by way of transistors X1 and X2 and transistors QN6 and QN8. Before the transistor QN9 is turned on, a transistor QN7 is on so as to keep transistors QN53A and Q53 off. The transistors QN53A and Q53 form part of a Widler current source 56. The Widler current source 56, which comprises part of the voltage regulator 34, is coupled through a transistor QN10 to provide 6.8 volts regulated.

Terminals 58 and 60 which are coupled to the transistors X3 and X4 provide signals OUTSD1 and OUTSD2 respectively. The signals OUTSD1 and OUTSD2 at the terminals 58 and 60 are always present and are used to keep the output in a pulldown mode, as described hereafter in connection with FIG. 5B.

As noted above, when $V_N>V_{REF}$, transistor QN9 is turned on. This turns off the transistor QN7, which turns on the Widler current source 56. This turns on the transistor X5 coupled to the transistor Q53 as well as a transistor QP5, to provide the regulated voltage of 6.8 volts. At the same time, a 5 volt shutdown is disabled at the base of a transistor Q58.

During low voltage operation, a point may be reached at which both of the transistors QN3 and QN4 are turned off.

When this occurs, transistors X3 and X4 which are coupled thereto are also off and will not turn on a transistor Q96 within the load discharge circuit 36. When such low voltage conditions occurs, a transistor Q96 should be on to the extent sufficient to turn off a capacitive load such as an external MOSFET by discharging any voltage stored in the MOSFET through the capacitive load discharge circuit 36. Normally, the transistors X3 and X4 (FIG. 5A) not being in pulldown would be a problem in terms of maintaining the transistor Q96 turned on. However, this is not a problem in the arrangement of FIGS. 5A and 5B according to the invention.

When $V_N<V_{REF}$, so that the regulated voltage of 6.8 volts is not produced, the output pulldown circuit 40, which is shown in FIG. 5B, begins to function. The output pulldown circuit 40 is self-sustaining in that it functions in response to the absence of the regulated reference voltage from the voltage regulator 34 to maintain the output 38 in pulldown. The output pulldown circuit 40 is powered by any voltage stored in the capacitive load coupled to the output 38, even though the voltage of the output 38 is falling during pulldown. As a result, the current requirements are such that a very low current can exist within the controller 26 and still sustain operation.

The output pulldown circuit 40 acts to keep the transistor Q96 within the load discharge circuit 36 turned on, in the absence of the regulated voltage of 6.8 volts. As shown in FIG. 5B, the output pulldown circuit 40 includes transistors Q111 and Q113, which together with a transistor XQ112 comprises the comparator 44 and the multiplier 46 shown in FIG. 4. The transistor Q113 is coupled to be biased by the presence or absence of the 6.8 volt regulated voltage at a terminal 62. The transistor Q111 comprises part of a current mirror which is coupled to drive the transistor Q96 within the load discharge circuit 36 when the transistor Q111 is on.

When $V_N>V_{REF}$, the Widler current source 56 is turned on and the regulated voltage of 6.8 volts is provided. When the regulated voltage of 6.8 volts is present at the terminal 62, the voltage divider 42 comprised of resistors R101 and R102 turns the transistor Q113 on and the transistor Q111 off. This turns off the transistor XQ112 which is coupled to the transistor Q111. The collectors of the transistor XQ112 function in a high impedance manner and do not interfere with normal operation of the load discharge circuit 36. When $V_N$ becomes less than $V_{REF}$, however, the Widler current source 46 is turned off and the regulated voltage of 6.8 volts is not available. The absence of the 6.8 volts at the terminal 62 turns off the transistor Q113, and this in turn turns on the transistor Q111. The current mirror, comprised by the transistor Q111, drives the transistor Q96 so as to maintain the load discharge circuit 36 in the pulldown mode.

It has been found in power supply controllers according to the invention that very low pulldown currents on the order of 160 μamperes are possible, instead of the more usual 500 μamperes or greater. This is in keeping with the desire that the controller integrated circuit consume little current in the startup mode, when the input voltage is below the minimum or threshold level. The low pulldown current is made possible by a number of factors including shutoff of the voltage regulator 34 and use of the output 38 to maintain pulldown via the output pulldown circuit 40. There is better control of the current sources. The input voltage can drop to a very low value, because the output voltage is not a function of the input voltage.

It will also be appreciated that power supply controller circuits in accordance with the invention provide multiple output points, as well as being relatively insensitive to temperature variations in terms of the affects thereof on the startup current. This latter feature relates in part to the particular circuit used for the comparator and the regulator, in the specific example of FIG. 5A.

While the invention has been particularly shown and described with reference to a preferred embodiment thereof, it will be understood by those skilled in the art that various changes in form and details may be made therein without departing from the spirit and scope of the invention.

I claim:

1. A power supply controller coupled to a capacitive load capable of providing power temporarily and responsive to an input voltage comprising the combination of:

means for driving the load when the input voltage exceeds a reference value; and means for driving the load into a pull down mode using power stored in the capacitive load from the output of tile load when the input voltage is less than the threshold value.

2. A power supply controller in accordance with claim 1, wherein the means for driving the load into a pull-down mode includes a comparator and a multiplier.

3. A power supply controller in accordance with claim 1, wherein the power supply controller provides means for driving the load when the input voltage exceeds a reference value includes means for providing a reference signal, and the means for driving the load when the input voltage is less than the threshold value is operative; to drive the load circuit when the reference signal is not provided into the pull-down mode.

4. A power supply controller in accordance with claim 3, wherein the means for providing a reference signal comprises a voltage regulator, and the means for driving the load circuit when the input voltage is less than the threshold value includes a voltage divider coupled to the voltage regulator.

5. A power supply controller coupled to a load circuit that stores energy responsive to an input voltage and comprising the combination of:

a voltage regulator operative when the input voltage exceeds a threshold value, and else being inoperative;

means for applying the regulated reference voltage to drive the load circuit when the regulated reference voltage is provided; and means responsive to the absence of the regulated reference voltage for pulling down the output voltage using energy from the load.

6. A power supply controller in accordance with claim 5, wherein the load circuit has an output voltage and the means responsive to the absence of the regulated reference voltage pulls down the output voltage using in part the output voltage thereof.

7. A power supply controller for providing power to a load comprising the combination of:

means for providing an input voltage;

means for comparing the input voltage with a reference value;

first driving means responsive to the means for comparing for driving the load when the input voltage exceeds the reference value; and second driving means for driving the load with power provided from the load temporarily into a power down mode when the input voltage is less than the reference value.

8. The invention set forth in claim 7, wherein the first driving means comprises a voltage regulator coupled to provide a regulated reference voltage when the input voltage exceeds the reference value.

9. The invention set forth in claim 8, wherein the second driving means is operative to drive the load in response to power provided by the load circuit when the voltage regulator does not provide the regulated reference voltage.

10. The invention set forth in claim 8, wherein the second driving means comprises a capacitive load discharge circuit which includes a first transistor coupled between the load and a voltage node, and the second driving means includes a second additional transistor coupled to be biased by the regulated reference voltage, when present, and a current mirror circuit including a third additional transistor coupled to the second additional transistor and to the first transistor.

11. The invention set forth in claim 10, wherein the first transistor is coupled to be biased into nonconduction when the reference voltage is not provided, to turn on the current mirror circuit and the second transistor to drive the transistor of the load circuit into power down.

12. A power supply controller coupled to an output load comprising the combination of:

means for providing a reference voltage to drive the output load when an input voltage of the controller is above a threshold value; and an output pulldown circuit for powering minimum functions within the power supply controller including driving the output load into a pulldown mode for a sufficient period when the reference voltage is not provided by the means for providing.

13. The invention set forth in claim 12, wherein the output pulldown circuit includes a reference voltage transistor coupled to be biased by the reference voltage.

14. The invention set forth in claim 13, wherein the transistor is biased into nonconduction when the reference voltage is not provided by the means for providing, and the output pulldown circuit includes a current mirror coupled to be turned on to drive the output load into pulldown when the transistor is biased into nonconduction.

15. The invention set forth in claim 14, wherein the current mirror includes a second transistor coupled to be biased into conduction when the reference voltage transistor is biased into nonconduction.

16. The invention set forth in claim 14, wherein the output pulldown circuit includes a second transistor coupled to be biased into conduction by the current mirror when the current mirror is turned on.

17. A method for controlling the providing of power to an output load, the method comprising:

providing a regulated voltage to the load, wherein power is provided to the load;

comparing a signal dependent upon the regulated voltage with a threshold;

stopping the providing of the regulated voltage to the load when the signal crosses the threshold in a first direction;

forcing the load into a power down mode by at least one switch at least partially temporarily powered by power drawn from the load.

18. The method of claim 17, wherein the method further comprises:

comparing the reference voltage with the voltage across the load; and the forcing of the load into the power down mode occurs in response to the comparison of the reference voltage with the voltage across the load.

19. The method of claim 18, wherein the method further includes multiplying the comparison.

20. A circuit for powering down a capacitive load coupled to the output of a power source when a regulated voltage source is in a first condition, the circuit comprising:

a comparator determining when the regulated voltage source is in a first condition and a second condition; and a pulldown switch responsive to the comparator to be in a first state if the comparator determines the regulated voltage source is in the first condition and a second state if the comparator determines the source is in the second state, in the first state the switch being open and in the second state the switch coupling the load to a reference voltage, whereby the load is in a power down mode, and wherein the pulldown switch is at least partially powered by energy supplied by the load at the start of the pulldown mode.

21. The circuit of claim 20, wherein the circuit further includes a multiplier responsive to the output of the comparator to couple the comparator to the pulldown switch.

22. The circuit of claim 20, wherein the circuit further includes a current mirror responsive to the multiplier to couple the switch to the comparator.

23. The circuit of claim 20, wherein the circuit further includes:

a voltage regulator providing the regulated voltage source for the output;

a reference voltage generator; and a second comparator comparing a reference voltage supplied by the reference voltage generator with the regulated voltage source output.

24. The circuit of claim 20, wherein the output load includes a transistor and the transistor is biased on by the current mirror when the load is in power down mode.

25. A circuit for providing a regulated voltage to a load with a power down mode, the circuit comprising:

a voltage regulator providing a switching signal and a regulated voltage at least some of the time;

a comparator determining whether the regulated voltage is present;

a first switch coupled to the load and responsive to the comparator such that the switch powers down the load when the regulated voltage is absent; and a second switch responsive to the switching signal and coupled to the first switch to keep the load powered down when the regulated voltage is absent.

26. The circuit of claim 25, wherein the first and second switches comprise transistors each having a base, a collector, and an emitter, the collector and the emitter of the transistor of the second switch coupling the vase and collector of the transistor of the first switch together when the load is powered down.

27. The circuit of claim 25, wherein the first switch obtains at least a part of the power for the switch from the load.

* * * * *